US006989360B2

(12) United States Patent
Danner et al.

(10) Patent No.: US 6,989,360 B2
(45) Date of Patent: Jan. 24, 2006

(54) TEXTILE FIBER DEGREASING AGENTS, THEIR PRODUCTION AND THEIR USE

(75) Inventors: Bernard Danner, Riedisheim (FR); Francis Palacin, Riedisheim (FR)

(73) Assignee: Clariant Finance (BVI) Limited, Tortola (VG)

( * ) Notice: Subject to any disclaimer, the term of this patent is extended or adjusted under 35 U.S.C. 154(b) by 107 days.

(21) Appl. No.: 10/483,555

(22) PCT Filed: Jul. 9, 2002

(86) PCT No.: PCT/IB02/02688

§ 371 (c)(1),
(2), (4) Date: Jan. 9, 2004

(87) PCT Pub. No.: WO03/006734

PCT Pub. Date: Jan. 23, 2003

(65) Prior Publication Data

US 2004/0186040 A1 Sep. 23, 2004

(30) Foreign Application Priority Data

Jul. 11, 2001 (EP) ..... 01810692

(51) Int. Cl.
*C11D 1/72* (2006.01)
*C11D 1/75* (2006.01)
*C11D 3/43* (2006.01)
*C11D 3/44* (2006.01)

(52) U.S. Cl. ..... 510/341; 510/342; 510/350; 510/356; 510/360; 510/499; 510/503; 510/506; 8/636; 8/441; 8/648

(58) Field of Classification Search ..... 510/336, 510/341, 342, 350, 356, 360, 499, 503, 506; 8/137, 636, 441, 648
See application file for complete search history.

(56) References Cited

U.S. PATENT DOCUMENTS 4,572,721 A 2/1986 Danner
5,447,575 A * 9/1995 Crump et al. ..... 134/42
5,512,060 A 4/1996 Fornelli et al.
5,710,333 A 1/1998 Badex et al.
5,728,179 A 3/1998 Gehling et al.
6,200,948 B1 3/2001 Traber et al.

FOREIGN PATENT DOCUMENTS

| | | |
|---|---|---|
| EP | 636737 | 2/1995 |
| EP | 0696661 | 2/1996 |
| GB | 738014 | 10/1955 |
| WO | WO 94/22996 | 10/1994 |
| WO | WO 96/03483 | 2/1996 |

OTHER PUBLICATIONS

English Abstract for JP 55137260, Apr. 14, 1979.

* cited by examiner

*Primary Examiner*—Gregory R. Del Cotto
(74) *Attorney, Agent, or Firm*—Anthony A. Bisulca

(57) ABSTRACT

Aqueous textile fiber degreasing agents ($W_E$) essentially consisting of (A) at least one amine oxide of the average formula (I)

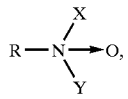

as defined in claim 1, (B) at least one hexanediol, (C) at least one secondary, branched or cyclic hexanol, (D) at least one aminosurfactant of the average formula (II)

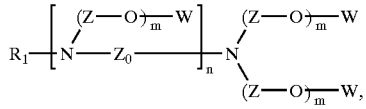

as defined in claim 1 and (E) water, and optionally at least one formulation additive (F), their production and use, particularly under alkaline conditions, in textile goods production.

11 Claims, No Drawings

TEXTILE FIBER DEGREASING AGENTS, THEIR PRODUCTION AND THEIR USE

In the industrial production of textile material, from filament production to finishing of the textile goods [for example yams, lengths of fabric (fabric webs or tubular goods), semi-finished goods or finished goods], assistants are used for the production processes on high-speed production machines (spinning, twisting, winding, spooling, respooling, weaving, knitting, dyeing, cutting, sewing or knotting machines, machines for rolling up or folding up and packaging, etc.), particularly, for example, spinning additives, spinning oils, spooling oils, sizes, smoothing agents, lubricants, slip agents or other assistants and compositions of this type, in order that attrition or friction in or on the substrate and between substrate and machine parts is reduced to a minimum or is matched to the respective process and the machine used in order to enable production to be carried out at the highest possible speed and with the highest possible output and to avoid damage and/or flaws in the goods produced to the greatest possible extent. Thus, use is made, for example, of spinning additives, spinning oils, spooling oils, warp smoothing agents, loom oils, ring traveller greases, sizes, spin finishes, softening agents, dry and/or wet slip agents, etc., which contain suitable grease-type substances (in particular waxes, greases and/or oils), or also wax-containing finishing agents, which improve the dry machine processability (for example the respooling of yarns or the high-speed sewability of fabrics).

With respect to a dyeing or brightening process, it is necessary to remove the applied grease-type substances from the substrate in advance, at least to such an extent that the applied greasy layer does not represent a barrier or other significant obstacle to the uniform distribution and fixing of the dye or optical brightener on the substrate, and the goods can be dyed or optically brightened in a fault-free manner without the levelling and fastness properties corresponding to the dyes employed being impaired. It is also possible to use waxes as assistants in colour printing, which are then washed out of the goods. Furthermore, other finishing agents and assistants (for example fabric softeners, antistatics, antifoams, synthetic resin finishes) may also contain grease-type substances of this type, or the substrates can be finished with certain waxes or greases or oils in order to achieve certain lustre or handle effects after dyeing and/or optical brightening. It may also occasionally occur that grease-type products of this type occur on the substrate as undesired soiling and under certain circumstances result in faulty dyeings. These grease-type products and their assistant substances may be very different, and the substrates may also be of a different nature and make different requirements of the treatment agents and conditions.

Depending on the processing, production process, substrate and/or desired effect, the removal of applied grease-type products of this type may thus be necessary in one or also a plurality of steps before the goods leave the particular production factory for shipping. Thus, it is necessary, for example, to remove grease-type substances of this type, for example before dyeing or optical brightening or before final finishing. Undesired grease soiling—which sometimes cannot be detected until on the inspection table—should also be removed. A faulty dyeing to which grease-type products of this type have been applied, for example as finish or as undesired soiling, also has to be degreased before the dyeing is removed for correction.

In order to remove the grease-type substances mentioned, simple rinsing with water is generally not sufficient inasmuch as they are insoluble or insufficiently soluble or self-emulsifiable in water, but instead are lipophilic substances. Various cleaning agents, which may naturally work in different ways, are used for this purpose in industry. With organic solvents, particularly with dry-cleaning solvents, grease-type products of this type can be removed relatively well. For reasons of environmental pollution with the very large amounts of such solvents necessary and also for occupational hygiene reasons, however, it is more desired to wash the goods with suitable surfactant systems in aqueous liquors. A popular surfactant category employed for this purpose comprises surfactant amine oxides and their liquid (aqueous) formulations. In formulations of this type, however, a variety of problems can occur, for example the cleaning agents are not suitable or are insufficiently effective for all grease-type products which can occur on the substrate, or they are not compatible with certain products present in the liquors or on the substrate and are, for example, precipitated and thereby lose effectiveness, or they have to be used under conditions (for example at low temperature or under acidic conditions) which are unsuitable for some substrates or greases. In addition, the chemical composition of the grease-containing products employed is not always or/and is not completely known to the textile manufacturer, and it is therefore not possible for a selectively acting degreasing agent to be chosen either. Consequently, there is a desire for textile fibre degreasing compositions which are effective for practically all grease-type components which can occur in applied products of this type and with which practically all other components are compatible.

In addition, the product may under certain circumstances not be sufficiently storage- and transport-stable in liquid compositions, with the consequence that it no longer has the original effectiveness—for example after extended storage and/or in the case of relatively large temperature variations, for example also after freezing and re-thawing.

EP 636737 A1 describes compositions comprising certain cationic surfactants and further additions selected from acids, non-ionic surfactants, water soluble non-ionic polymers and/or organic solvents in defined quantities, for removing finishing agents containing silicone oil from textile substrates; the mentioned cationic surfactants comprise in one sub-group also certain defined amine oxides, certain N,N-diethanolamino-alkylamine oxides (with $C_{13/14}$-, $C_{13/15}$-, $C_{16/18}$-and $C_{18}$-alkyl) being described in the examples, and as solvents there are mentioned certain low molecular alcohols and glycols (ethanol, isopropanol, 1-methoxypropanol, diethyleneglycol, tripropyleneglycol are named). The compositions are described for use in an aqueous medium, and a procedure with a mechanical stress as low as possible of the goods is indicated as being particularly advantageous (page 7, lines 17–20).

WO 94/22996 A1 and WO 9603483 A1 describe compositions comprising certain cationic surfactants (which in one sub-group comprise also certain defined amine oxides) in combination with defined organic solvents of very slight water solubility and other defined water soluble organic solvents and optionally some further additives, as multi surface cleaning agents. They are more particularly described for use by application on a soiled surface e.g. by pouring or spraying on the soiled area and then wiping dry.

JP 55–137260 A2 describes compositions comprising certain cationic surfactants (which in one sub-group comprise also certain defined amine oxides) in combination with defined polyglycolester surfactants, as high speed desizing agents. In the examples there is described a desizing method in which a sized polyester test cloth of 3 cm×3 cm is treated in a bath of about 1 liter of desizing solution.

It has now been found that certain amine oxide formulations which comprise certain amine oxides in combination with certain secondary hexanols, certain hexanediols and certain surfactant amines, as defined below as ($W_E$), can be used under alkaline conditions, and at the same time are surprisingly suitable as degreasing agents for washing-out a very wide variety of grease-type products, as are used industrially in the production of textile material (for example in spinning additives, spinning oils, spooling oils, loom oils and knitting oils, smoothing agents, slip agents or other assistants, compositions and finishing agents of this type, etc., for example as mentioned above) or as may occasionally also occur as soiling on the substrate, out of the particular textile material—in particular as all-round degreasing agents in the area of industrial textile goods production—and are also distinguished by surprisingly good compatibility with further components and by surprisingly good storage and transport stability (particularly of the concentrated compositions).

The invention relates to the textile fibre degreasing agents (or compositions) defined, their production and their use in the production of textile goods.

A first subject-matter of the invention is thus aqueous textile fibre degreasing agents ($W_E$) essentially consisting of (A) at least one amine oxide of the average formula

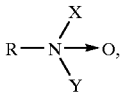

(I)

in which

R signifies an aliphatic hydrocarbon radical having on average from 10 to 24 carbon atoms, X signifies —($C_{2-4}$-alkylene-O)$_x$—H, Y signifies —($C_{2-4}$-alkylene-O)$_y$—H, x signifies from 1 to 5 and y signifies from 1 to 5, where x+y is from 2 to 10, and at least 2 of the (x+y) $C_{2-4}$-alkylene groups stand for ethylene, (B) at least one hexanediol, (C) at least one secondary, branched or cyclic hexanol, (D) at least one surfactant of the average formula

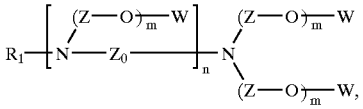

(II)

in which $R_1$ signifies an aliphatic hydrocarbon radical having on average from 10 to 24 carbon atoms, $Z_0$ signifies $C_{2-4}$-alkylene, Z in each case signifies $C_{2-4}$-alkylene, W in each case signifies hydrogen or a monobasic acid group, optionally in salt form, m signifies a number ≧1 and n signifies 0, 1 or 2, where (n+2)·m=5 to 50, and at least 2 of the (2+n)·m $C_{2-4}$-alkylene groups Z stand for ethylene, and (E) water, and optionally at least one formulation additive (F).

Suitable as (A) are any desired amine oxides in which the radical R contains on average from 10 to 24 carbon atoms, as are known in industry or can be produced analogously to known methods, for example by oxidation of the corresponding tertiary amines of the formula

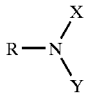

(III)

with peroxides, preferably with hydrogen peroxide.

The amines of the formula (III) are known or can be produced by methods known per se, for example by reaction of primary amines of the formula $$R—NH_2 \quad (IV)$$

or—if at least one of x and y is >1—of a corresponding amine of the formula (III) in which x and y each signify 1, with the respective $C_{2-4}$-alkylene oxides.

The amine of the formula (III) or (IV) may be a unitary amine or also a mixture, principally a technical-grade mixture, in which the number of carbon atoms in the individual radicals R occurring is, for example, in the range from $C_6$ to $C_{24}$, preferably in the range from $C_{10}$ to $C_{22}$, in particular in the range from $C_{12}$ to $C_{22}$. The radicals R in the formulae (I) and (III) or (IV) advantageously contain on average from 12 to 22, preferably from 12 to 20 carbon atoms, and the technical-grade mixtures advantageously consist of a mixture of 2 or more representatives having a number of carbon atoms in the range from 10 to 22, preferably from 12 to 22, in the radical R. They may be saturated or unsaturated, in particular ethylenically unsaturated. As amines of the formula (IV)—as starting materials for tertiary amines of the formula (III) and amine oxides of the formula (I) which can be produced therefrom—mention may be made, for example, of: laurylamine, myristylamine, cetylamine, oleylamine, stearylamine, arachidylamine, behenylamine, docosenylamine and the technical-grade amines tallow fatty amine, hydrogenated tallow fatty amine, technical-grade oleylamine and coconut fatty amine. Of the said amines, preference is given to those with unsaturated hydrocarbon radicals and the technical-grade mixtures which contain amines with unsaturated hydrocarbon radicals, in particular technical-grade mixtures in which the amines with unsaturated hydrocarbon radicals preponderate.

The radicals X and Y in (A) are in particular those as may be formed by addition of the corresponding $C_{2-4}$-oxiranes. The $C_{2-4}$-alkyleneoxy groups are advantageously isopropyleneoxy or ethyleneoxy groups. In the amines of the formula (III) or in the amine oxides of the formula (I), at least two ethyleneoxy groups are present per molecule. Advantageously, at least half, i.e. at least 50%, of the number of $C_{2-4}$-alkyleneoxy groups present—but at least two thereof—are ethyleneoxy groups; in other words, if x+y=4 to 10 in the formula (I) or (III), at least 50% of the number of $C_{2-4}$-alkyleneoxy groups present are advantageously ethyleneoxy groups. Preferably, at least 80% of the number of $C_{2-4}$-alkyleneoxy groups present—but at least two thereof—are ethyleneoxy groups; in other words, if x+y=2.5 to 10 in the formula (I) or (III), at least 80% of the number of $C_{2-4}$-alkyleneoxy groups present are preferably ethyleneoxy groups. Particularly preferably, and most simply, all alkyleneoxy groups present are ethyleneoxy groups.

Preferred amines of the formula (III) or preferred amine oxides (A) of the formula (I) are those in which x+y=2 to 5, particularly from 2 to 3, and all $C_{2-4}$-alkyleneoxy groups are ethyleneoxy groups.

The hexanediol (B) may be any desired diol of this type, in particular a linear, cyclic or branched diol, advantageously in which at least one of the two hydroxyl groups, preferably both, are secondary or tertiary. As (B), mention may be made, for example, of: 1,6-hexanediol or a linear or preferably branched hexanediol, preferably with at least one secondary hydroxyl group, particularly preferably in which either both hydroxyl groups are secondary or in which one thereof is secondary and the other is tertiary. In particular, mention may be made of the following: 1,6-hexanediol, 2,5-hexanediol, 2-methyl-1,5-pentanediol and 2-methyl-2,4-pentanediol, of which 2,5-hexanediol and 2-methyl-2,4-pentanediol are preferred, above all 2-methyl-2,4-pentanediol.

The secondary hexanol (C), which is branched or cyclic, may be any desired hexanol of this type, for example cyclohexanol or 2-methyl4-pentanol, of which the latter is particularly preferred.

The amines (D) of the formula (II) are either known or can be produced from known starting compounds analogously to known methods, for example by addition of the alkyleneoxy groups onto the corresponding starting amines of the formula $$R_1[NH—Z_0]_nNH_2 \quad (V),$$

in particular, for example, by reaction of these amines with corresponding $C_{2-4}$-oxiranes, and, if desired, reaction with a compound which is able to introduce a monobasic acid group.

In the amines of the formula (II) or (V), the hydrocarbon radicals $R_1$ may be any desired aliphatic radicals having on average from 10 to 24 carbon atoms, principally as usually occur in the corresponding amines of the formula (V), and in particular as also described above for the radicals R in the amines of the formulae (III) and (IV), also with regard to the distribution and with regard to those advantageously and preferably employed. The amines of the formula (V) in which n signifies 1 or 2 can, as is known, be produced from amines of the type of the formula (IV), for example by alkylation with $C_{2-4}$-alkyleneimines or with (meth)acrylonitrile and reduction of the —CN group to the —$CH_2$—$NH_2$ group. Also of the amines of the formula (II) or (V), preference is given to those with unsaturated hydrocarbon radicals, in particular the technical-grade mixtures which contain unsaturated radicals $R_1$, in particular in which in the radicals $R_1$ the unsaturated ones preponderate.

The radicals R and $R_1$ may have the same meaning as one another or different meanings to one another.

The alkylene groups $Z_0$ may be linear or, if they contain 3 or 4 carbon atoms, also branched. $Z_0$ preferably stands for ethylene or 1,3-propylene, particularly preferably for 1,3-propylene. The index n may signify 0, 1 or 2; n preferably stands for 1 or 0, particularly preferably for 0.

The radicals —Z—O— in (D) are, in particular, those as may be formed by addition of the corresponding $C_{2-4}$-oxiranes onto the amines of the formula (V). The $C_{2-4}$-alkyleneoxy groups —Z—O— are advantageously isopropyleneoxy or ethyleneoxy groups. In the amines of the formula (II), at least two ethyleneoxy groups are present per molecule. Advantageously, at least half, i.e. at least 50%, of the number of $C_{2-4}$-alkyleneoxy groups —Z—O— present—but at least two thereof—are ethyleneoxy groups; in other words, if (n+2)·m=4 to 50 in the formula (II), at least 50% of the number of $C_{2-4}$-alkyleneoxy groups —Z—O— present are advantageously ethyleneoxy groups. Preferably, at least 80% of the number of —Z—O— groups present—but at least two thereof—are ethyleneoxy groups; in other words, if (n+2)·m=2.5 to 50 in the formula (II), in this case at least 80% of the number of $C_{2-4}$-alkyleneoxy groups —Z—O— present are preferably ethyleneoxy groups. Particularly preferably, and most simply, all alkyleneoxy groups —Z—O— present are ethyleneoxy groups.

(D) advantageously contains on average from 8 to 45, preferably from 12 to 36 ethyleneoxy groups.

Particularly worthy of mention for the introduction of a monobasic acid group, if desired in salt form (for example as alkali metal salt, alkaline earth metal salt or ammonium salt or also as internal salt), is esterification with sulphuric acid, which can be carried out in a manner known per se, for example by reaction of the oxyalkylation products of the formula

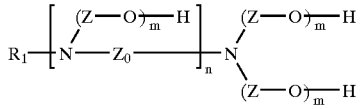

(VI)

with aminosulphonic acid.

The amines of the formula (II) may, depending on the pH, be in protonated or non-protonated form. If the molecule contains one or more of the acid groups as W, i.e. has an amphoteric character, it may correspondingly, depending on the pH, be in protonated form, in particular as an internal salt, or in non-protonated form. The non-protonated form is particularly preferred.

W preferably stands only for hydrogen.

As (D), use is advantageously made of amines of the average formula

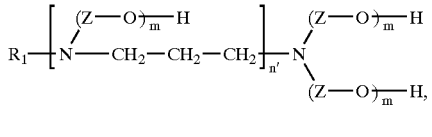

(IIa)

in which n' signifies 0 or 1, preferably of the average formula

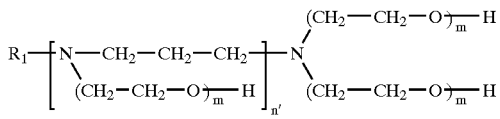

(IIa')

or, particularly preferably

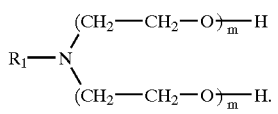

(IIb)

(D) is principally a product of the addition of ethylene oxide and, if desired, propylene oxide onto an amine or aminopropylamine of the formula

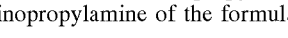

(IIa"), which optionally has been sulphated on at least one hydroxyl group, where (n'+2)·m=8 to 45, preferably from 12 to 36, in particular of the average formula (IIb), in which m is from 5 to 20, preferably from 6 to 16, or of the average formula

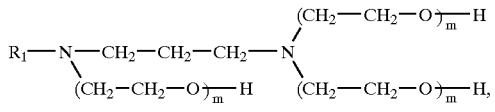

(IIc)

in which m is from 4 to 15, preferably from 5 to 12.

Components (A), (B), (C) and (D) may be combined with water (E) to give the corresponding compositions, and formulation additives (F) may be added, if desired.

The content of components (B), (C) and (D) in the aqueous compositions and their weight ratio to (A) may vary in broad ranges, with the proportion of (C) preferably not exceeding the content of (A). The concentration of (A) may likewise vary in a broad range.

The weight ratio (B)/(A) is, for example, in the range from 0.05/1 to 3/1, advantageously from 0.1/1 to 2/1, preferably from 0.2/1 to 1.5/1.

The weight ratio (C)/(A) is, for example, in the range from 0.01/1 to 1/1, advantageously from 0.02/1 to 0.5/1, preferably from 0.05/1 to 0.3/1.

The weight ratio (D)/(A) is, for example, in the range from 0.02/1 to 5/1, advantageously from 0.04/1 to 3/1, preferably from 0.07/1 to 1.5/1, particularly preferably from 0.1/1 to 0.8/1.

The weight ratio (A)/[(A)+(B)+(C)+(D)] is, for example, in the range from 10/100 to 80/100, preferably from 20/100 to 60/100.

The weight ratio (D)/[(A)+(B)+(C)+(D)] is, for example, in the range from 2/100 to 60/100, preferably from 5/100 to 25/100.

The concentration of the aqueous compositions ($W_E$) can vary greatly, and it is possible to produce dilute to highly concentrated compositions. The water content, i.e. the content of (E), may be, for example, in the range from 10 to 95% by weight, for concentrated compositions advantageously in the range from 10 to 80% by weight, preferably from 20 to 65% by weight, based on ($W_E$), for highly concentrated ones for example in the range from 10 to 50% by weight.

Optionally, formulation additives (F) may additionally be employed. As formulation additives (F), those which are suitable for setting and maintaining the physical and chemical form of the compositions more precisely and also maintaining their efficacy, or protecting them against interfering external effects, come in particular into consideration.

Thus, as (F), the following come in particular into consideration:

($F_1$) agents against the harmful action of microorganisms, ($F_2$) at least one acid and/or base for pH adjustment, ($F_3$) at least one non-ionogenic surfactant and/or ($F_4$) at least one sequestering agent.

Suitable as ($F_1$) are any desired conventional products which are suitable for protecting the aqueous compositions against the damaging action, for example, of bacteria or fungi, for example bacteriostatics or microbicides, in particular fungicides. These products can be employed in the commercially available forms and in the corresponding recommended concentrations, for example in concentrations in the range from 0 to 0.2% by weight, based on ($W_E$).

Component ($F_2$) serves for precise setting of the pH values of ($W_E$), in particular of the concentrated compositions. As ($F_2$), use can be made of acids known per se, in particular mineral acids (for example hydrochloric acid, sulphuric acid, phosphoric acid) or low-molecular-weight aliphatic carboxylic acids, for example with from 1 to 6 carbon atoms (for example formic acid, acetic acid, lactic acid, malic acid or citric acid), of which acetic acid is preferred, or bases known per se, in particular alkali metal hydroxides or carbonates (for example sodium hydroxide, potassium hydroxide, lithium hydroxide, sodium carbonate, potassium carbonate or lithium carbonate), ammonia or low-molecular-weight aliphatic amines, such as mono-, di- or triethanol- or -isopropanolamine, of which the alkali metal hydroxides and carbonates, above all sodium hydroxide and carbonate, are preferred.

The pH of the aqueous compositions ($W_E$) can be in the acidic to basic range, preferably in the weakly acidic to weakly basic range, in particular at approximately neutral values. The type and concentration of ($F_2$) are advantageously selected in such a way that, based on a composition having a water content of 50%, the pH is in the range from 4 to 10, advantageously from 5 to 9, preferably from 6 to 8. Most simply, acetic acid may be added in order to set a pH of from 6.5 to 7.5.

As non-ionogenic surfactants ($F_3$), it is possible to employ products having an emulsifier or dispersant character which are known per se, for example products of the addition of ethylene oxide and, if desired, propylene oxide onto corresponding alcohols, for example of the type of the formula

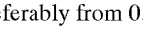

(VII), in which $R_2$ signifies a hydrocarbon radical having from 9 to 24 carbon atoms, for example onto aliphatic fatty alcohols having from 9 to 18 carbon atoms, or onto alkylphenols, in which alkyl contains, for example, from 6 to 12 carbon atoms, or onto dialkylphenols, in which alkyl contains, for example, from 3 to 9 carbon atoms. The number of adducted ethyleneoxy groups is advantageously selected in such a way that the HLB of the non-ionogenic surfactant is in the range from 7 to 18, preferably from 10 to 16. However, these non-ionogenic surfactants serve only for, where appropriate, supporting the other components and/or as assistant substance in the production of the mixtures, and are generally present in small amounts, if present at all, in particular in a smaller proportion than component (D). The content of ($F_3$) can be, for example, in the range from 0 to 5% by weight, preferably from 0 to 1% by weight, based on (A), where the content of ($F_3$) preferably makes up less than half of the content of (D), preferably less than one quarter of the content of (D). Particularly preferably, no surfactant ($F_3$) is employed.

If the compositions ($W_E$) according to the invention should be used in aqueous liquors which have very high or interfering water hardness, it is possible, if desired, to employ sequestering agents ($F_4$) in order to bind the interfering calcium and/or other metal ions (for example iron ions). The commercially available sequestering agents which are conventional per se, such as EDTA (ethylenediaminetetraacetic acid, as the sodium salt), NTA (nitrilotriacetic acid, as the sodium salt) or diethylenetriaminepentamethylenephosphonic acid sodium salt, are suitable. These sequestering agents ($F_4$) can be employed in effective concentrations which are usual per se, for example in the range from 0 to 10% by weight, preferably from 0 to 5% by weight, based on (A). Since industrial water usually has an adjusted relatively low hardness (pH about 7–8), the addition of a sequestering agent ($F_4$) is normally not necessary.

Thus, a subject-matter of the invention is also aqueous textile fibre degreasing agents ($W_E$') which essentially consist of components (A), (B), (C), (D) and (E) and optionally a formulation additive ($F_1$) and/or ($F_2$) and/or ($F_4$), and aqueous textile fibre degreasing agents ($W_E$") which essentially consist of components (A), (B), (C), (D) and (E) and optionally a formulation additive ($F_1$) and/or ($F_2$).

The textile fibre degreasing agents ($W_E$) according to the invention can be produced in a simple manner, by mixing the individual components together, in particular by mixing (A), (B), (C) and (D) with one another in the presence of water (E) and optionally adding (F). Depending on the type and nature of (F), this can be admixed before, at the same time as or after the addition of the water. For example, it is possible to follow a procedure in which a solution of (A) in (E) is initially introduced, optionally in the presence of (B), and the remaining components, and optionally residual (B) and/or (E), are admixed. In accordance with a particular embodiment of the invention, the amine oxide (A) can be produced by oxidation of the corresponding tertiary amine of the formula (III) with hydrogen peroxide in aqueous solution, optionally in the presence of (B), and mixing the resultant aqueous solution of (A) and optionally (B) in (E) with the remaining components. The mixing of the components is advantageously carried out under conditions under which the mixture is stirrable, for example in the temperature range from 15 to 80° C., advantageously from 20 to 60° C.

The mixture ($W_E$) produced in this way is ready to use and can be packaged, for example, in suitable containers and transported and/or stored. It is distinguished by its transport and storage stability even under frost or heat conditions (for example at temperatures in the range from −20° C. to +60° C., and also even if it should solidify at temperatures below 0° C., it can be used without problems on re-thawing) and is pumpable at temperatures $\geqq 0°$ C. It serves as textile fibre degreasing agent for washing out the very wide variety of grease-type products (P) which occur in textile production, in particular greases, oils or waxes, and also further components which may occur as accompanying substances to these grease-type products, and can, in particular, serve as all-round degreasing agents in the area of industrial production of textile goods. It can be metered directly in undilute form into the respective processing steps in which the corresponding fibre degreasing is to be carried out or—particularly if it is in highly concentrated form—if desired in pre-water-diluted form (for example with a water content of 60–95%) into the water for the washing liquor.

As mentioned at the outset, it is important that the substrate be sufficiently freed from interfering grease-type coatings before a dyeing operation or optical brightening operation in order that the dyeing or optical brightening can be carried out without problems, in particular in optimum levelness and with optimum fastnesses of the resultant dyeings or brightenings. If the goods have been freed insufficiently from grease-type products (P) before the dyeing, this may result in faulty goods, for example through either 1) the grease coating on the goods hindering the dyeing operation, and the resultant dyeing having poor levelness and/or fastness, or 2) the excess grease (P) collecting in apparatus parts—also, for example, in the tenter frame dryer—and soiling the goods, or both 1) and 2).

The flaws which arise (grease spots and/or faulty dyeing) are usually not observed until on the inspection table during goods inspection. The faulty goods have to be cleaned and, if the dyeing is also faulty, it has to be stripped-off and repeated. If the grease-type coating applied is not removed to an adequate extent before the dyeing, the dyeing obtained may be faulty (for example non-level and/or in poor fastness) and has to be corrected, i.e. stripped-off and repeated, and the excess grease coating has to be removed before the faulty dyeing is stripped-off.

Furthermore, the textile substrates may contain certain grease-type products applied during or after the dyeing or printing, for example in certain colour printing methods (such as, for example, batik), or grease-type products, for example waxes and/or silicones, may sometimes have been applied after the dyeing, in order, for example, to improve the machine processability or the handle of the goods, and in which case it may be necessary, for example for any correction, to remove these grease-type products from the goods again.

Depending on the processing of the goods, a very wide variety of grease-type products (P) (oils, greases, waxes) can be used, as oils, for example, optionally modified vegetable and mineral oils, or also silicone oils, as greases, for example, optionally modified vegetable, animal and mineral greases, as waxes, for example, optionally modified vegetable, animal and mineral waxes, or also synthetic waxes. Depending on the type and property, they are employed in the various processing steps in textile goods production. For example, mention may be made of the following compositions which comprise or consist of grease-type products of this type: spinning oils, spooling oils, warp smoothing agents, loom oils, ring traveller greases, sizes, spin finishes, softening agents, dry and/or wet slip agents, etc., or also wax-containing finishing agents, which improve the dry machine processability (for example the re-spooling of yarns or the high-speed sewability of fabrics). Grease soiling on the goods may, depending on the apparatus and method, also contain soil components which are particularly interfering and difficult to remove, for example, in addition to the said greases, also graphite, abraded metal and/or heat-modified greases or oils (such as, for example, in spooling or knitting oils). Furthermore, assistants for colour printing, for dyeing or for finishing (for example fabric softeners, antistatics, antifoams, synthetic resin finishes) or final finishes for providing the substrate with certain lustre or handle effects after dyeing which also contain grease-type products (in particular in final finishes usually also silicones) (P) may be present on the goods.

The degreasing agents ($W_E$) according to the invention are suitable for washing the grease-type applied products (P)

mentioned out of a very wide variety of textile substrates (made from natural, semi-synthetic or synthetic materials, for example cotton, wool, silk, cellulose acetates, viscose, polyester, synthetic polyamides, polyurethanes and/or polyacrylonitrile, of which, in particular, the synthetic fibres—also microfibres—and fibre blends which contain or consist of synthetic fibres are to be emphasized) to a large extent and in a well-balanced ratio. Corresponding accompanying substances can also be removed correspondingly here.

A further subject-matter of the invention thus consists in the use of the textile fibre degreasing agents ($W_E$) according to the invention for washing applied grease-type products (P) out of textile fibre materials during production of the textile goods before finishing thereof.

The washing-out is carried out in aqueous liquor, under alkaline conditions and in particular in the absence of other added wash-active surfactants and assistants. The alkaline conditions are advantageously selected in such a way that the pH of the liquor is in the range from 9 to 12, preferably from 10 to 11. These alkaline conditions can be generated by addition of conventional alkalis, for example with sodium carbonate, sodium hydroxide, potassium carbonate and/or potassium hydroxide. The liquor is preferably soda-alkaline, i.e. adjusted with sodium carbonate. The concentration of ($W_E$), based on the dry substrate, can vary in a broad range, depending on the method, apparatus, substrate and type and amount of (P), for example in discontinuous methods between 0.1 and 10%, preferably from 0.5 to 5% of dry matter [(A)+(B)+(C)+(D)], and in continuous methods in a concentration of dry matter [(A)+(B)+(C)+(D)] in the liquor in the range from 0.1 to 20 g/l, preferably from 0.5 to 10 g/l. The wash-out temperature can be in treatment temperature ranges which are conventional per se, for example in the range from 40 to 95° C., preferably from 50 to 90° C., it being possible to select the suitable temperature range depending on the textile substrate and the type of products (P) to be washed out. The wash-out treatment can have any desired duration per se, for example in the range from 5" to 1 h, depending on the method, and can, in particular, also be relatively short, and it is also possible to achieve good results in very short treatment times, in discontinuous methods, for example, in the range from 10 to 40 minutes; in continuous methods, good wash-out effects can be achieved, for example at temperatures in the range from 60 to 95° C., in from 5" to 5' (preferably from 6" to 2'), without the entire process having to be interrupted or reduced in speed. If desired, washing-out of this type can be repeated one or more times, for example once to 3 times. In general, one treatment without repetition is sufficient.

The compositions ($W_E$) can also be rinsed out well and quickly, for example at from 15 to 95° C., advantageously with one or two rinses at elevated temperature (for example >50° C. or also >55° C., for example at 60–95° C., principally from 60 to 90° C.) and one or two rinses at lower temperature (for example <60° C. or also <55° C., for example at 15–50° C., principally from 20 to 50° C.).

A further subject-matter of the invention is thus also a method for the dyeing or optical brightening of textile fibre material which contains an applied grease-type product (P) before the dyeing or optical brightening, which is characterized in that the (P)-containing substrate is washed with an aqueous textile fibre degreasing agent ($W_E$) under alkaline conditions and then rinsed, if desired subjected to intermediate drying and then dyed or optically brightened by the proposed method, and also a method for correction of a dyeing on a textile substrate on which (P), as defined above, is also present, which is characterized in that (P) is washed out of the substrate under alkaline conditions using a degreasing agent ($W_E$), the dyeing is stripped off using a stripping agent, and the de-dyed substrate is re-dyed.

The process of the invention can be carried out in any suitable machine, in particular e.g. in a textile treatment assembly for continuous processes, in which degreasing may be carried out in one or more intermediate vessels before dyeing, optical brightening or otherwise finishing of the textile at the same speed, or in a textile treatment vessel for exhaust treatment, in which degreasing may be carried out at a similar liquor-to-goods ratio as e.g. subsequent dyeing, optical brightening or other finishing, especially even in a jet-dyeing machine.

The process according to the invention enables perfectly degreased textile materials to be obtained which—if the degreasing is carried out before the dyeing or optical brightening—can be optimally dyed and/or optically brightened, in particular in level shades of optimum fastness.

In the following examples, the parts are parts by weight and the percentages are per cent by weight; the temperatures are indicated in degrees Celsius. The following amine oxides (A) and surfactants (D) are employed:

Amine Oxides (A) of the Average Formula

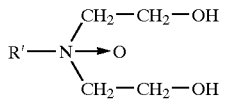

(1)

Amine Oxide ($A_1$)

in which R' has the following percentage composition:

1% of $C_{12}H_{25}$
4% of $C_{14}H_{29}$
12% of $C_{16}H_{33}$
83% of $C_{18}H_{35}$

Amine Oxide ($A_2$)

in which R' has the following percentage composition:

5% of $C_{14}H_{29}$
30% of $C_{16}H_{33}$
65% of $C_{18}H_{35}$

Amine Oxide ($A_3$)

of the average formula

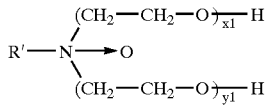

(2)

in which x1+y1=3 and R' has the following percentage composition:

1% of $C_{12}H_{25}$
4% of $C_{14}H_{29}$
12% of $C_{16}H_{33}$
83% of $C_{18}H_{35}$

Surfactants (D)

Surfactant ($D_1$)

of the average formula

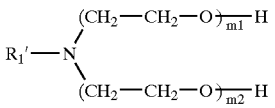

(3)

in which m1+m2=15 and $R_1'$ has the following percentage composition:
15% of $C_{16}H_{33}$
80% of $C_{18}H_{35}$
5% of $C_{18}H_{37}$ Surfactant ($D_2$)

of the average formula

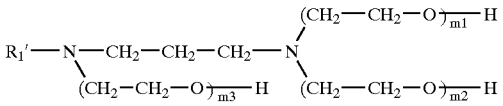

(4)

in which m1+m2+m3=28 and $R_1'$ has the following percentage composition:
2% of $C_{14}H_{29}$
30% of $C_{16}H_{33}$
40% of $C_{18}H_{35}$
25% of $C_{18}H_{37}$
3% of $C_{20}H_{41}$ Surfactant ($D_3$)

of the average formula

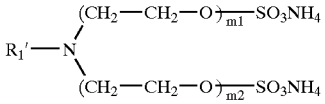

(5)

in which m1+m2=20 and $R_1'$ has the following percentage composition:
6% of $C_{16}H_{33}$
42% of $C_{18}H_{37}$
12% of $C_{20}H_{41}$
40% of $C_{22}H_{45}$ Degreasing Agent Compositions ($W_E$)

EXAMPLE 1

Product ($W_{E1}$)
23.0% of ($A_1$)
20.0% of 2-methyl-2,4-pentanediol
3.4% of 4-methyl-2-pentanol
5.6% of ($D_1$)
48.0% of water.

EXAMPLE 2

Product ($W_{E2}$)
23.0% of ($A_1$)
20.0% of 2-methyl-2,4-pentanediol
3.4% of cyclohexanol
5.6% of ($D_1$)
48.0% of water.

EXAMPLE 3

Product ($W_{E3}$)
23.0% of ($A_2$)
20.0% of 2-methyl-2,4-pentanediol
5.0% of cyclohexanol
6.0% of ($D_1$)
46.0% of water.

EXAMPLE 4

Product ($W_{E4}$)
23.0% of ($A_1$)
20.0% of 2-methyl-2,4-pentanediol
3.4% of 4-methyl-2-pentanol
6.0% of ($D_2$)
47.6% of water.

EXAMPLE 5

Product ($W_{E5}$)
23.0% of ($A_1$)
20.0% of 2-methyl-2,4-pentanediol
3.4% of 4-methyl-2-pentanol
6.0% of ($D_3$)
47.6% of water.

EXAMPLE 6

Product ($W_{E6}$)
23.0% of ($A_3$)
20.0% of 2-methyl-2,4-pentanediol
3.4% of 4-methyl-2-pentanol
5.6% of ($D_1$)
48.0% of water.

EXAMPLE 7

Product ($W_{E1}$)
18.6% of ($A_1$)
20.0% of 2-methyl-2,4-pentanediol
3.4% of 4-methyl-2-pentanol
10.0% of ($D_1$)
48.0% of water.

The products ($W_{E1}$) to ($W_{E7}$) can be produced simply by mixing a 50% aqueous dispersion of the amine oxides at from about 20 to 60° C. with the other components (B), (C) and (D) and optionally adding any residual water and if necessary cooling to room temperature. The pH is 7 or is set to 7, if necessary by addition of a small amount of glacial acetic acid. If desired, 0.1% of "Saniprot® 94-08" (a fungicide in liquid form, from Sanitized, Switzerland) is added.

APPLICATION EXAMPLE A

Untreated knitted goods in tubular form made from polyamide microfibres which contain a fibre spin finish and knitting oil are washed in a jet-dyeing machine (Brazzoli Superlux) under the following conditions:

| | |
|---|---|
| Fabric weight: | 77 kg |
| Liquor-to-goods ratio: | 12:1 (920 l of water) |
| Washing out: | for 20 minutes at 90° C. with 2 g/l of product ($W_{EI}$) and 1.5 g/l of calcined soda; |
| Rinses (2): | the first for 10 minutes at 60° C., the second for 10 minutes at 40° C. |

The goods are then dyed in a pale violet shade with a combination of acid dyes. The levelness of the dyeing is perfect.

APPLICATION EXAMPLE B

Untreated knitted goods made from polyester microfibres which contain a fibre spin finish and knitting oil are washed in a jet-dyeing machine (Brazzoli Superlux) under the following conditions:

| | |
|---|---|
| Fabric weight: | 100 kg |
| Liquor-to-goods ratio: | 13:1 (1300 l of water) |
| Washing out: | for 30 minutes at 90° C. with 1 g/l of product ($W_{EI}$) and 1 g/l of calcined soda; |
| Rinses: | the first for 10 minutes at 70° C., the second for 10 minutes at 50° C. |

The goods are then dyed in a mid-red shade with a combination of dispersion dyes. The levelness of the dyeing is perfect.

APPLICATION EXAMPLE C

A fabric web made from non-thermoset untreated knitted goods comprising 79% of polyamide and 21% of elastomer which contain a fibre spin finish and knitting oil are treated continuously (fabric speed of about 20 m/min) in a Noseda washing machine in the following way:

The goods are fed through a first section containing 6 g/l of product ($W_{E1}$) and 2 g/l of calcined soda in water at 60° C., then through four rinsing sections containing water at in each case 70° C. (in the 1st and 2nd sections), 50° C. (in the 3rd section) and 25° C. (in the 4th section).

After this treatment, the fabric is thermoset for 20 seconds at 197° C. and then dyed in an olive-green shade. The levelness of the dyeing is perfect.

In an analogous manner to product ($W_{E1}$), one of each of products ($W_{E2}$) to ($W_{E7}$) is employed in the above application examples A to C.

What is claimed is:

1. Aqueous textile fibre degreasing agent ($W_E$) consisting essentially of (A) at least one amine oxide of the formula (I)

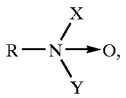

in which

R signifies an aliphatic hydrocarbon radical having from 10 to 24 carbon atoms,

X signifies —($C_{2-4}$-alkylene-O)$_x$—H,

Y signifies —($C_{2-4}$-alkylene-O)$_y$—H, x signifies from 1 to 5 and y signifies from 1 to 5, where x+y is from 2 to 10, and at least 2 of the (x+y) $C_{2-4}$-alkylene groups stand for ethylene, (B) a hexanediol, (C) a secondary, branched or cyclic hexanol, (D) at least one surfactant of the formula (II)

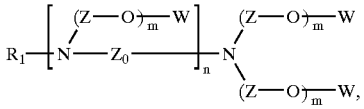

in which $R_1$ signifies an aliphatic hydrocarbon radical having from 10 to 24 carbon atoms, $Z_0$ signifies $C_{2-4}$-alkylene, Z in each case signifies $C_{2-4}$-alkylene, W in each case signifies hydrogen or a monobasic acid group, optionally in salt form, m signifies a number ≧1 and n signifies 0, 1 or 2, where (n+2)·m=5 to 50, and at least 2 of the (2+n)·m $C_{2-4}$-alkylene groups Z stand for ethylene, and (E) water, and optionally at least one formulation additive (F).

2. Aqueous textile fibre degreasing agent ($W_E$) according to claim 1, wherein the at least one formulation additive (F) is selected the group consisting of:

($F_1$) an agent against the harmful action of microorganisms, ($F_2$) at least one acid and/or base for pH adjustment, ($F_3$) at least one non-ionogenic surfactant ($F_4$) at least one sequestering, and mixtures thereof.

3. Aqueous textile fibre degreasing agent which is an aqueous textile fibre degreasing agent ($W_E$) according to claim 2 which consists essentially of components (A), (B), (C), (D) and (E) and optionally, at least one of formulation additives ($F_1$), ($F_2$) and ($F_4$).

4. Aqueous textile fibre degreasing agent which is an aqueous textile fibre degreasing agent according to claim 3 consisting essentially of components (A), (B), (C), (D) and (E) and optionally, at least one of formulation additives ($F_1$) and ($F_2$).

5. Process for the production of textile fibre degreasing agents ($W_E$) according to claim 1, where (A), (B), (C) and (D) are mixed with one another in the presence of water (E), and optionally (F) is added.

6. Process according to claim 5, where the amine oxide (A) of the formula (I) is produced by oxidation of the corresponding amine of the formula

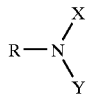

(II)

with hydrogen peroxide in aqueous medium, in the presence of at least some of (B).

7. A method for washing applied grease products (P) which comprise oils, greases and/or waxes out of textile fibre materials under alkaline conditions during production of the textile fibre materials and before finishing of the textile fibre materials, comprising the steps of:

providing a textile fibre materials having an applied grease-type products (P);

providing a textile fibre degreasing agents ($W_E$) according to claim 1; and contacting said textile fibre degreasing agents ($W_E$) with said textile fibre material.

8. The method for washing applied grease products (P) which comprise oils, greases and/or waxes out of textile fibre materials under alkaline conditions during production of the textile fibre materials and before finishing of the textile goods according to claim 7 wherein said textile fibre materials and are made from textile fibre materials made from synthetic fibres, synthetic fibre blends or mixtures of synthetic fibres and natural, optionally modified wherein said fibre materials are to be dyed or optically brightened.

9. Process for the dyeing or optical brightening of textile fibre material which contains at least one applied grease product (P) which comprises oils, greases and/or waxes, wherein before the dyeing or optical brightening, the (P)-containing substrate is washed with an aqueous textile fibre degreasing agent ($W_E$) according to claim 1 under alkaline conditions and then rinsed, optionally subjected to intermediate drying, and then dyed or optically brightened by contacting said textile fibre material with a dye or optical brightening composition.

10. Method for correcting a dyeing on a textile substrate on which applied grease products (P), which comprise oils, greases and/or waxes are present, wherein (P) is washed out of the substrate under alkaline conditions using a degreasing composition ($W_E$) according to claim 1, stripping the dye with a stripping agent, and re-dyeing the de-dyed substrate.

11. Method for cleaning, a dyed or optically brightened textile substrate where applied grease products (P), which comprise oils, greases and/or waxes are present, and before finishing of the textile substrate, wherein (P) is washed out of the dyed or optically brightened substrate under alkaline conditions using a degreasing agent ($W_E$) according to claim 1.

* * * * *